US010424305B2

(12) United States Patent
Biswas et al.

(10) Patent No.: US 10,424,305 B2
(45) Date of Patent: Sep. 24, 2019

(54) MDCT-DOMAIN ERROR CONCEALMENT

(71) Applicant: DOLBY INTERNATIONAL AB, Amsterdam Zuidoost (NL)

(72) Inventors: Arijit Biswas, Nuremberg (DE); Tobias Friedrich, Nuremberg (DE); Klaus Peichl, Furth (DE)

(73) Assignee: Dolby International AB, Amsterdam Zuidoost (NL)

( * ) Notice: Subject to any disclaimer, the term of this patent is extended or adjusted under 35 U.S.C. 154(b) by 77 days.

(21) Appl. No.: 15/533,625

(22) PCT Filed: Dec. 8, 2015

(86) PCT No.: PCT/EP2015/079005

§ 371 (c)(1),
(2) Date: Jun. 6, 2017

(87) PCT Pub. No.: WO2016/091893

PCT Pub. Date: Jun. 16, 2016

(65) Prior Publication Data

US 2017/0372707 A1 Dec. 28, 2017

Related U.S. Application Data

(60) Provisional application No. 62/089,563, filed on Dec. 9, 2014.

(51) Int. Cl.
*G10L 19/005* (2013.01)
*G10L 19/02* (2013.01)

(52) U.S. Cl.
CPC ..... *G10L 19/005* (2013.01); *G10L 19/0212* (2013.01)

(58) Field of Classification Search
CPC ..... G10L 19/005; G10L 19/0212
See application file for complete search history.

(56) References Cited

U.S. PATENT DOCUMENTS 5,349,549 A * 9/1994 Tsutsui ..... G06F 17/142 708/402
6,351,730 B2 2/2002 Chen
(Continued)

FOREIGN PATENT DOCUMENTS

CN 101308660 B * 7/2011
CN 101937679 1/2012
(Continued)

OTHER PUBLICATIONS

Kurniawati E. et al., "Error concealment scheme for MPEG-AAC", Communications Systems 2004, The Ninth International Conference, pp. 240 244, 7-7, Sep. 2004.
(Continued)

*Primary Examiner* — Daniel C Washburn
*Assistant Examiner* — Oluwadamilola M Ogunbiyi

(57) ABSTRACT

An error-concealing audio decoding method comprises: receiving a packet comprising a set of MDCT coefficients encoding a frame of time-domain samples of an audio signal; identifying the received packet as erroneous; generating estimated MDCT coefficients to replace the set of MDCT coefficients of the erroneous packet, based on corresponding MDCT coefficients associated with a received packet directly preceding the erroneous packet; assigning signs of a first subset of MDCT coefficients of the estimated MDCT coefficients, wherein the first subset comprises such MDCT coefficients that are associated with tonal-like spectral bins, to coincide with signs of corresponding MDCT coefficients of said preceding packet; randomly assigning signs of a second subset of MDCT coefficients of the estimated MDCT coefficients, wherein the second subset comprises MDCT coefficients associated with noise-like spectral bins; replacing the erroneous packet by a conceal-
(Continued)

ment packet containing the estimated MDCT coefficients and the signs assigned.

10 Claims, 4 Drawing Sheets

(56) References Cited

U.S. PATENT DOCUMENTS

| | | | | |
|---|---|---|---|---|
| 7,693,710 | B2 | 4/2010 | Jelinek | |
| 7,873,515 | B2 | 1/2011 | Padhi | |
| 8,239,421 | B1 * | 8/2012 | Marwah | H03M 7/3084 382/245 |
| 8,255,207 | B2 | 8/2012 | Vaillancourt | |
| 8,397,117 | B2 | 3/2013 | Laaksonen | |
| 8,457,115 | B2 | 6/2013 | Zhan | |
| 8,620,644 | B2 | 12/2013 | Ryu | |
| 8,731,910 | B2 | 5/2014 | Wu | |
| RE46,388 | E * | 5/2017 | Matsumura | |
| 2004/0128128 | A1 * | 7/2004 | Wang | G10L 19/005 704/229 |
| 2006/0259298 | A1 * | 11/2006 | Matsumura | G10L 19/032 704/230 |
| 2007/0063877 | A1 * | 3/2007 | Shmunk | G10L 19/0204 341/50 |
| 2008/0126096 | A1 * | 5/2008 | Oh | G10L 19/005 704/265 |
| 2008/0126904 | A1 * | 5/2008 | Sung | G10L 19/005 714/746 |
| 2010/0250265 | A1 * | 9/2010 | Taleb | G10L 19/02 704/503 |
| 2011/0191111 | A1 | 8/2011 | Chu | |
| 2014/0019142 | A1 * | 1/2014 | Mittal | G10L 19/005 704/500 |
| 2014/0142957 | A1 | 5/2014 | Sung | |
| 2015/0213808 | A1 * | 7/2015 | Disch | G10L 19/02 704/500 |
| 2015/0287417 | A1 * | 10/2015 | Disch | G10L 19/008 704/500 |
| 2015/0379998 | A1 * | 12/2015 | Naslund | G10L 19/025 704/203 |
| 2016/0104490 | A1 * | 4/2016 | Sukowski | G10L 19/06 704/501 |
| 2017/0213561 | A1 * | 7/2017 | Faure | G10L 19/20 |
| 2018/0025739 | A1 * | 1/2018 | Kjoerling | G10L 21/0388 704/500 |

FOREIGN PATENT DOCUMENTS

| | | |
|---|---|---|
| EP | 2772910 | 9/2014 |
| RU | 2488897 | 7/2013 |
| WO | 2014/042439 | 3/2014 |
| WO | 2014/052746 | 4/2014 |
| WO | 2014/126520 | 8/2014 |

OTHER PUBLICATIONS

Sang-Uk R. et al., "An MDCT Domain Frame-Loss Concealment Technique for MPEG Advanced Audio Coding", Acoustics, Speech and Signal Processing 2007, ICASSP 2007, IEEE International Conference, col. 1, pp. I-273, I-276, Apr. 15-20, 2007.

Zhu M. et al., "Efficient Algorithm for Packet Loss Concealment Based on Sinusoid and Transient in MDCT Domain", Circuits, Communications and Systems 2009, PACCS D9, Pacific-Asia Conference, pp. 330, 333, May 16-17, 2009.

Lauber P. et. al, "Error Concealment for Compresseddigital Audio", Preprints of Papers presented at the AES Convention, Sep. 1, 2001, pp. 1-11, XP008075936.

Jayant, N. et al Digital Coding of Waveforms, Principles and Applications to Speech and Video, Englewood Cliffs, NJ: Prentice-Hall, 1984.

* cited by examiner

MDCT-DOMAIN ERROR CONCEALMENT

TECHNICAL FIELD

The invention disclosed herein generally relates to encoding and decoding of audio signals, and in particular to a method and apparatus for concealing errors.

BACKGROUND ART

Modified discrete cosine transforms (MDCT) and corresponding inverse modified discrete transforms (IMDCT) are used for example in audio coding and decoding techniques, such as MPEG-2 and MPEG-4 Audio Layer, Advanced Audio Coding, MPEG-4 HE-AAC, MPEG-D USAC, Dolby Digital (Plus) and other proprietary formats.

In application of such techniques, errors sometime occur due to loss of or errors in packets relating to a transform of an audio signal, before or after the packets are received in a decoding system. Such errors include for example loss or distortion of packets and may result in an audible distortion of the decoded audio signal.

Methods have thus been provided for error concealment in case errors occur in packets. The error concealment methods are generally divided into estimating concealment methods where the erroneous frames are replaced by estimations and non-estimating concealment methods for example using muting of erroneous frames, frame repetition or noise substitution.

Estimating concealment methods include methods using estimations in the frequency-domain, such as those disclosed in U.S. Pat. No. 8,620,644, and methods using estimations in the time-domain, such as those disclosed in International Pat. Pub. No. WO/2014/052746.

All techniques for concealment of errors suffer from issues relating to the trade-off between the quality of the concealment and the complexity of the estimations required. Hence, there is a need for further methods for error concealment.

BRIEF DESCRIPTION OF THE DRAWINGS

Example embodiments will now be described with reference to the accompanying drawings, on which.

All figures are schematic and generally only depict parts which are necessary in order to elucidate the disclosure, whereas other parts may be omitted or merely suggested. Unless otherwise indicated, like reference numerals refer to like parts in different figures.

DETAILED DESCRIPTION

Figure 1A:
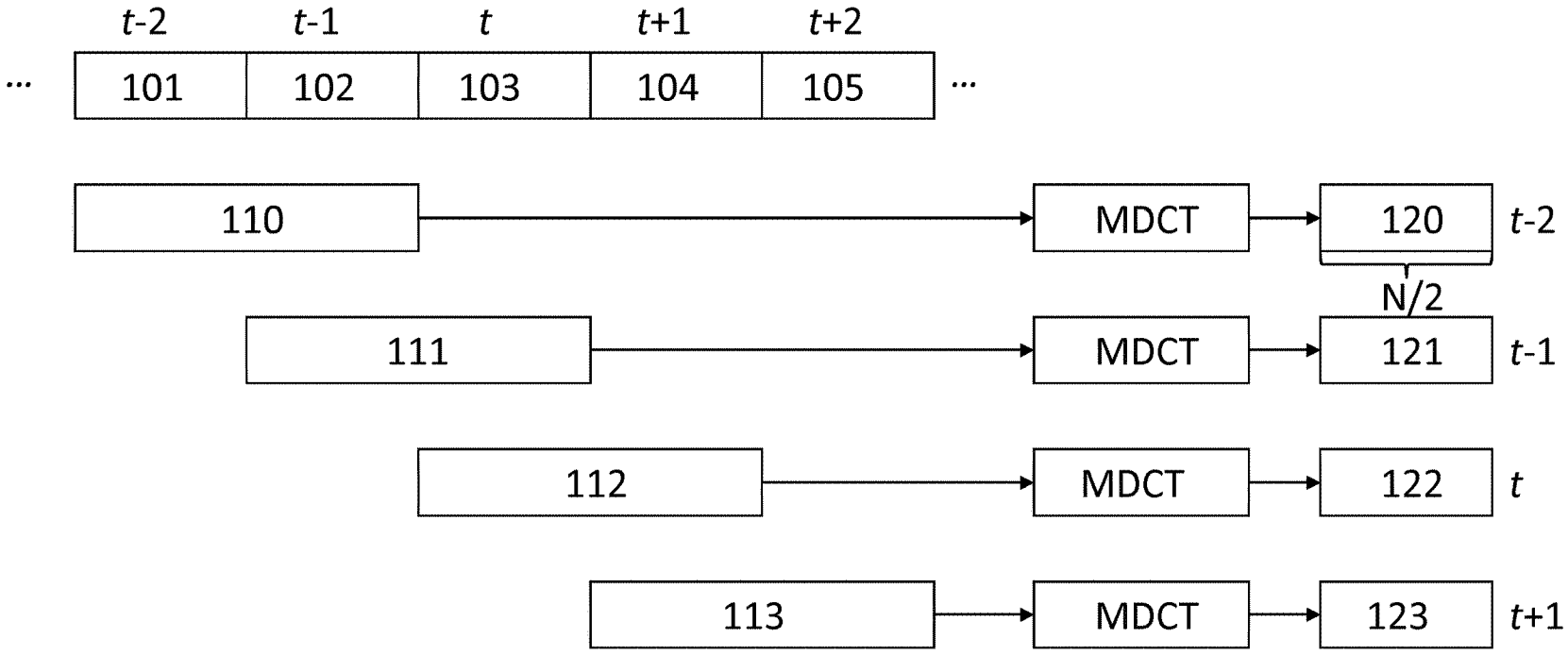
FIGS. 1A and 1B depict, by way of example, generalized block diagrams of MDCT and IMDCT, respectively.

In view of the above, an objective is to provide decoder systems and associated methods aiming at providing desired error concealment without significant complexity.

I. OVERVIEW—FIRST ASPECT

According to a first aspect, example embodiments propose decoding methods, decoding systems, and computer program products for decoding. The proposed methods, decoding systems and computer program products may generally have the same features and advantages.

According to example embodiments, there is provided a method for concealing errors in packets of data that are to be decoded in a MDCT based audio decoder arranged to decode a sequence of packets into a sequence of decoded frames. The method includes receiving, from an MDCT based audio encoder arranged to encode an audio signal, a packet comprising a set of MDCT coefficients associated with a frame comprising time-domain samples of the audio signal, and identifying the received packet to be an erroneous packet in that the received packet comprises one or more errors. The method further includes generating estimated MDCT coefficients to replace the set of MDCT coefficients of the erroneous packet, the estimated MDCT coefficients being based on corresponding MDCT coefficients associated with a received packet, which directly precedes the erroneous packet in the sequence of packets. The method further includes assigning signs of a first subset of MDCT coefficients of the estimated MDCT coefficients, wherein the first subset comprises such MDCT coefficients that are associated with tonal-like spectral bins of the packet, to be equal to corresponding signs of the corresponding MDCT coefficients of the received packet, which directly precedes the erroneous packet in the sequence of packets, and randomly assigning signs of a second subset of MDCT coefficients of the estimated MDCT coefficients, wherein the second subset comprises such MDCT coefficients that are associated with noise-like spectral bins of the packet; generating a concealment packet based on the estimated MDCT coefficients and the selected signs of the packet; and replacing the erroneous packet with the concealment packet.

As used herein, "erroneous packet" represents a packet which includes MDCT coefficients that differ in some way in relation to MDCT coefficients of a correct MDCT of correct samples of the audio signal. This could mean that part of or the whole packet is missing in the sequence of packets or that part of or the whole packet includes distortions.

Identification of tonal-like spectral bins and noise-like spectral bins of the packet may be performed using any suitable method. The order of identification of tonal-like spectral bins and noise-like spectral is arbitrary and may for example depend on the method used.

It is to be noted that the terms "first subset" and "second subset" are only used to distinguish the two subsets from each other in the text and not to indicate the order of processing in relation to the two different subsets. The order of which the assigning is performed is arbitrary. Assignment may be performed for the MDCT coefficients for the first subset first and second subset last or the other way around. Furthermore, in some example embodiments the assignment may not be performed for the MDCT coefficients such that all MDCT coefficients associated with the first subset are assigned consecutively and all MDCT coefficients associated with the second subset are assigned consecutively. In some example embodiments the assignment may be made first for one or more MDCT coefficients of one of the subsets, then for one or more MDCT coefficients of the other subset, then one or more of said one of the subset, etc. Furthermore, a packet does not necessarily have MDCT coefficients associated with both noise-like spectral bins and tonal-like spectral bins. In some example embodiments the packet may have all MDCT coefficients associated with noise-like spectral bins or all associated with tonal-like spectral bins such that one of the subsets is empty. Finally, an MDCT coefficient is typically identified as either belonging to the first subset or belonging to the second subset.

It is to be noted that basing estimations of MDCT coefficients and signs of MDCT coefficients associated with the received packet, which directly precedes the erroneous packet in the sequence of packets, does not exclude that the estimations may additionally be based on MDCT coefficients and signs of MDCT coefficients associated with received packets earlier in the sequence of packets than the packet which directly precedes the erroneous packet.

As used herein, "generating estimated MDCT coefficients" relates to assigning values to the MDCT coefficients which are not necessarily the best approximation of the values the MDCT coefficients would have had if there had not been any errors in the erroneous packet but which achieve desired error concealment properties such that unwanted distortion of the decoded audio signal is avoided or reduced.

As used herein, "estimated MDCT coefficients" relates to the absolute value of the estimated MDCT coefficients.

According to example embodiments the method further comprises determining, for each of the estimated MDCT coefficients, whether the MDCT coefficient is associated with a tonal-like spectral bin or a noise-like spectral bin based on spectral peak detection of an approximation of a power spectrum associated with the erroneous packet, wherein the approximated power spectrum is based on the power spectrum associated with the received packet, which directly precedes the erroneous packet in the sequence of packets.

According to some embodiments the method further comprises determining, for each of the estimated MDCT coefficients, whether the MDCT coefficient is associated with a tonal-like spectral bin or a noise-like spectral bin based on metadata associated with the packet, wherein the metadata is received in a bit stream comprising the sequence of packets and the metadata.

As used herein, "metadata" relates to bit stream parameters that are used for controlling audio decoder processing.

The metadata may be sent in packets of the sequence of packets and outside the packets in a bit stream comprising the sequence of packets and the metadata.

Metadata that may be used for determining whether MDCT coefficients are associated with tonal-like or nose-like spectral bins is metadata that is used for controlling certain audio decoder processing based on audio content-type. One example of such metadata is a metadata in relation to a companding tool used in AC-4. In some embodiments, the companding tool may be switched off for tonal signals and hence, if companding is OFF then the signal is assumed to be tonal. As another example, if the longest MDCT is used, the audio content is most likely a tonal signal.

According to some embodiments, the estimated MDCT coefficients are selected to be equal to the corresponding MDCT coefficients of the received packet, which directly precedes the erroneous packet in the sequence of packets.

According to some embodiments, the estimated MDCT coefficients are selected to be equal to the corresponding MDCT coefficients of the received packet, which directly precedes the erroneous packet in the sequence of packets, energy adjusted in scale-factor band resolution by an energy scaling factor. For a detailed description of scale-factor band resolution reference is made to ETSI TS 103 190 V1.1.1 "Digital Audio Compression (AC-4) Standard, 2014-04, the contents of which is incorporated herein by reference.

According to some embodiments, the received packet comprises N/2 MDCT coefficients associated with N windowed time-domain samples of the audio signal, further comprising: generating an intermediate frame comprising N windowed time-domain aliased samples from the concealment frame by means of IMDCT; modifying windowed time-domain aliased samples of the intermediate frame based on symmetry relations between the windowed time-domain aliased samples of the intermediate frame.

As used herein, "N" is an even integer.

As used herein, "intermediate frame comprising N windowed time-domain aliased samples" represents a frame of samples resulting from an IMDCT in a decoder system of MDCT coefficients received from an encoder. In some example embodiments an intermediate frame before overlap add is performed in the decoding system in order to produce a decoded frames in the sequence of decoded frames.

According to some embodiments, the modifying uses symmetry relations between a first half of a first half of the intermediate frame comprising N windowed time-domain aliased samples and a second half of the first half of the intermediate frame comprising N windowed time-domain aliased samples, and symmetry relations between a first half of a second half of the intermediate frame comprising N windowed time-domain aliased samples and a second half of the second half of the intermediate frame comprising N windowed time-domain aliased samples.

As used herein, "a first half of the intermediate frame" represents the first N/2 samples of the intermediate frame. If the samples of the intermediate frame are numbered consecutively from 0 to N−1, the first half would be samples 0 to N/2−1. Furthermore, "a second half of the intermediate frame" represents the last N/2 samples of the intermediate frame. If the samples of the intermediate frame are numbered consecutively from 0 to N−1, the second half would be samples N/2 to N−1.

As used herein, "a first half of a first half of the intermediate frame" represents a subset comprising the first N/4 samples of the first half of the intermediate frame, "a second half of the first half of the intermediate frame" represents a subset comprising the last N/4 samples of the first half of the intermediate frame, "a first half of a second half of the intermediate frame" represents a subset comprising the first N/4 samples of the second half of the intermediate frame, and "a second half of the second half of the intermediate frame" represents a subset comprising the last N/4 samples of the second half of the intermediate frame.

According to some embodiments, the received packet comprises N/2 MDCT coefficients associated with N windowed time-domain samples of the audio signal, further comprising: generating an intermediate frame comprising N windowed time-domain aliased samples from the concealment frame by means of IMDCT; modifying windowed time-domain aliased samples of the intermediate frame based on relations between the windowed time-domain aliased samples of the intermediate frame and windowed time-domain samples of the N time-domain samples of the audio signal.

Example embodiments provide that a previous decoded frame associated with a received packet, which directly precedes the erroneous packet in the sequence of packets, can be used as an approximation in the relations between windowed time-domain aliased samples of the first subset and windowed time-domain samples of the N windowed time-domain samples of the audio signal. The relations may then be used to modify the generated intermediate frame in order to enhance error concealment properties.

According example embodiments, there is provided a decoding system for concealing errors in packets of data that are to be decoded in an MDCT based audio decoder arranged to decode a sequence of packets into a sequence of decoded frames, the system comprising: a receiver section configured to receive, from an MDCT based audio encoder arranged to encode an audio signal, a packet comprising a set of MDCT coefficients associated with a frame comprising time-domain samples of the audio signal; an error detection section configured to identify the received packet to be an erroneous packet in that the received packet comprises one or more errors; an error concealment section configured to generate estimated MDCT coefficients to replace the set of MDCT coefficients of the erroneous packet, the estimated MDCT coefficients being based on corresponding MDCT coefficients associated with a received packet, which directly precedes the erroneous packet in the sequence of packets; assign signs of a first subset of MDCT coefficients of the estimated MDCT coefficients, wherein the first subset comprises such MDCT coefficients that are associated with tonal-like spectral bins of the packet, to be equal to corresponding signs of the corresponding MDCT coefficients of the received packet, which directly precedes the erroneous packet in the sequence of packets; randomly assign signs of a second subset of MDCT coefficients of the estimated MDCT coefficients, wherein the second subset comprises such MDCT coefficients that are associated with noise-like spectral bins of the packet; generate a concealment packet based on the estimated MDCT coefficients and the selected signs of the packet; and replacing the erroneous packet with the concealment packet.

II. OVERVIEW—SECOND ASPECT

According to a second aspect, example embodiments propose decoding methods, decoding systems, and computer program products for decoding. The proposed methods, decoding systems and computer program products may generally have the same features and advantages.

According to example embodiments there is provided a method for concealing errors in packets of data that are to be decoded in an MDCT based audio decoder arranged to decode a sequence of packets into a sequence of decoded frames. The method includes receiving, from an MDCT based audio encoder arranged to encode an audio signal, a packet comprising N/2 MDCT coefficients associated with N windowed time-domain samples of the audio signal, and identifying the packet to be an erroneous packet in that the packet comprises one or more errors. The method further includes estimating a first subset comprising N/4 windowed time-domain aliased samples of a first half of an intermediate frame comprising N windowed time-domain aliased samples associated with the erroneous packet, the estimation being based on relations between windowed time-domain aliased samples of the first subset and windowed time-domain samples of the N windowed time-domain samples of the audio signal, and estimating a second subset comprising remaining N/4 windowed time-domain aliased samples of the first half of the intermediate frame based on symmetry relations between windowed time-domain aliased samples of the second subset and windowed time-domain aliased samples of the first subset.

As used herein, "N" is an even integer.

As used herein, "erroneous packet" represents a packet which includes MDCT coefficients that differ in some way in relation to MDCT coefficients of a correct MDCT of correct samples of the audio signal. This could mean that part of or the whole packet is missing in the sequence of packets or that part of or the whole packet includes distortions.

As used herein, "intermediate frame comprising N windowed time-domain aliased samples" represents a frame of samples resulting from an inverse MDCT in a decoder system of MDCT coefficients received from an encoder. An intermediate frame is thus a frame of windowed time-domain aliased samples before overlap add is performed in the decoding system in order to produce a decoded frame in the sequence of decoded frames.

As used herein, "a first half of an intermediate frame" represents the first N/2 samples of the intermediate frame. If the samples of the intermediate frame are numbered consecutively from 0 to N−1, the first half would be samples 0 to N/2−1.

As used herein, "a first subset comprising N/4 windowed time-domain aliased samples" represents a subset comprising N/4 samples of the first half of the intermediate frame which need not be consecutive samples in the first half of the intermediate frame but should be selected such that redundant information is not produced in relation to information from the symmetry relations between samples of the second subset and samples of the first subset.

As used herein, "estimating a first subset" and "estimating a second subset" relate to assigning values to the windowed time-domain aliased samples of the first subset and of the second subset which are not necessarily the best approximations of the values they would have had if there had not been any errors in the erroneous packet but which achieve desired error concealment properties such that unwanted distortion of the decoded audio signal is avoided or reduced.

According to example embodiments the estimation of the first subset is based on a previous decoded frame associated with the received packet, which directly precedes the erroneous packet in the sequence of packets.

It is to be noted that basing estimations on the previous decoded frame associated with received packet, which directly precedes the erroneous packet in the sequence of packets, does not exclude that the estimations may additionally be based on earlier decoded frames associated with received packets earlier in the sequence of packets than the packet which directly precedes the erroneous packet.

Estimation of the first subset based on the previous decoded frame may in example embodiments be combined with the first subset comprising N/4 windowed time-domain aliased samples being the first half of the first half of the intermediate frame, wherein sample number n of the first subset is estimated as a windowed version of sample number n of the previous decoded frame minus a windowed version of sample number N/2−1−n of the previous decoded frame for n equals 0, 1 . . . , N/4−1.

Example embodiments provide that the relations between windowed time-domain aliased samples of the first subset and windowed time-domain samples of the N windowed time-domain samples of the audio signal can be reformulated by use of the overlap properties of the N windowed time-domain samples associated with the erroneous packet and previous N windowed time-domain samples associated with the received packet, which directly precedes the erroneous packet in the sequence of packets. Hence, a relation between the windowed time-domain aliased samples of the first subset and windowed time-domain samples of the previous N windowed time-domain samples of the audio signal is derived. Example embodiments further provide that the windowed time-domain samples of the previous N windowed time-domain samples of the audio signal can be approximated by windowed versions of samples of the previous decoded frame.

Estimation of the first subset based on the previous decoded frame, generating an estimated decoded frame, estimating a third subset and estimating a fourth subset may in example embodiments be combined with the first subset comprising N/4 windowed time-domain aliased samples being the first half of the first half of the intermediate frame, the third subset comprising N/4 windowed time-domain aliased samples being the first half of the second half of the intermediate frame, and wherein sample number n of the first subset is estimated as a windowed version of sample number n of the previous decoded frame minus a windowed version of sample number N/2−1−n of the previous decoded frame for n equals 0, 1, . . . , N/4−1, and wherein sample number n of the third subset is estimated as a windowed version of sample number n of the estimated decoded frame plus a windowed version of sample number N/2−1−n of the estimated decoded frame for n equals 0, 1, . . . , N/4−1.

It is to be noted that basing estimations on the estimated decoded frame associated with the erroneous packet, does not exclude that the estimations may additionally be based on earlier decoded frames associated with received packets earlier in the sequence of packets than the erroneous packet.

Example embodiments provide that the windowed time-domain samples of the previous N windowed time-domain samples of the audio signal can be approximated by windowed versions of the samples of the previous decoded frame and of the estimated decoded frame.

In some example embodiments the estimation of the first subset is based on an offset set comprising N/2 samples of a previous decoded frame associated with a received packet, which directly precedes the erroneous packet in the sequence of packets, and a further previous decoded frame associated with a received packet, which directly precedes the packet associated with the previous decoded frame in the sequence of packets, the offset set comprising k last samples of the further previous decoded frame and all samples except the k last samples of the previous decoded frame, where k<N/2. In the present example embodiments, k may be set based on maximization of self-similarity of a frame to be estimated with previous frames and k may for example be dependent on N.

Instead of using N/2 samples of the previous decoded frame only, N−k samples of the previous decoded frame are used together with k samples from the further previous decoded frame. More specifically, the k last samples of the further previous decoded frame and all samples except the k last samples of the previous decoded frame are used. This requires that k<N/2.

Estimation of the first subset based on the previous decoded frame, generating an estimated decoded frame, estimating a third subset and estimating a fourth subset may in example embodiments be combined with the estimation of the first subset being further based on a further previous decoded frame associated with a received packet, which directly precedes the packet in the sequence of packets associated with the previous decoded frame, the first subset comprising N/4 windowed time-domain aliased samples being the first half of the first half of the intermediate frame, the third subset comprising N/4 windowed time-domain aliased samples being the first half of the second half of the intermediate frame, sample number n of the first subset being estimated as a windowed version of sample number N/2−1+n−k of the further previous decoded frame minus a windowed version of sample number N/2−1−n−k of the previous decoded frame for n equals 0, 1, . . . , k and estimated as windowed version of sample number n−k−1 of the previous decoded frame minus a windowed version of sample number N/2−1−n−k of the previous decoded frame for n equals k+1, . . . , N/4−1, and sample number n of the third subset being estimated as a windowed version of sample N/2−1+n−k of the previous decoded frame minus a windowed version of sample number N/2−1−n−k of the estimated decoded frame for n equals 0, 1, . . . , k and wherein sample number n of the third subset being estimated as a windowed version of sample number n−k−1 of the estimated decoded frame plus a windowed version of sample number N/2−1−n−k of the estimated decoded frame for n equals k+1, . . . , N/4−1, where k≤(N/4−1.

In example embodiments there is provided a decoding system for concealing errors in packets of data that are to be decoded in an MDCT based audio decoder arranged to decode a sequence of packets into a sequence of decoded frames, the system comprising: a receiver section configured to receive, from an MDCT based audio encoder arranged to encode an audio signal, a packet comprising N/2 MDCT coefficients associated with N windowed time-domain samples of the audio signal; an error detection section configured to identify the packet to be an erroneous packet in that the packet comprises one or more errors; an error concealment section configured to: estimating a first subset comprising N/4 windowed time-domain aliased samples of a first half of an intermediate frame comprising N windowed time-domain aliased samples associated with the erroneous packet, the estimation being based on relations between windowed time-domain aliased samples of the first subset and windowed time-domain samples of the N windowed time-domain samples of the audio signal, and estimate a second subset comprising remaining N/4 windowed time-domain aliased samples of the first half of the intermediate frame based on symmetry relations between windowed time-domain aliased samples of the second subset and windowed time-domain aliased samples of the first subset.

III. OVERVIEW—THIRD ASPECT

According to a third aspect, example embodiments propose decoding methods, decoding systems, and computer program products for decoding. The proposed methods, decoding systems and computer program products may generally have the same features and advantages.

In some example embodiments there is provided a method for concealing errors in packets of data that are to be decoded in an MDCT based audio decoder arranged to decode a sequence of packets into a sequence of decoded frames. The method includes receiving, from an MDCT based audio encoder arranged to encode an audio signal, a packet comprising N/2 MDCT coefficients associated with N windowed time-domain samples of the audio signal, and identifying the packet to be an erroneous packet in that the packet comprises one or more errors. The method further includes estimating a decoded frame comprising N/2 samples associated with the erroneous packet to be equal to a second half of a previous intermediate frame comprising N non-windowed time-domain samples associated with a received packet, which directly precedes the erroneous packet in the sequence of packets.

As used herein, "N" is an even integer.

As used herein, "erroneous packet" represents a packet which includes MDCT coefficients that differ in some way in relation to MDCT coefficients of a correct MDCT of correct samples of the audio signal. This could mean that part of or the whole packet is missing in the sequence of packets or that part of or the whole packet includes distortions.

As used herein, "estimating a decoded frame" relate to assigning values to the samples of the decoded frame which are not necessarily approximations of the values they would have had if there had not been any errors in the erroneous packet but which achieve desired error concealment properties such that unwanted distortion of the decoded audio signal is avoided or reduced.

As used herein, "a second half of a previous intermediate frame" represents the last N/2 samples of the previous intermediate frame. If the samples of the intermediate frame are numbered consecutively from 0 to N−1, the second half would be samples N/2 to N−1.

In some example embodiments there is provided estimating a subsequent decoded frame comprising N/2 samples associated with a received packet, which directly follows the erroneous packet in the sequence of packet, to be equal to a first half of an subsequent intermediate frame comprising non-windowed time-domain samples associated with the received packet, which directly follows the erroneous packet in the sequence of packets.

In some example embodiments there is provided a decoding system for concealing errors in packets of data that are to be decoded in an MDCT based audio decoder arranged to decode a sequence of packets into a sequence of decoded frames, the method comprising: a receiver section configured to receive, from an MDCT based audio encoder arranged to encode an audio signal, a packet comprising N/2 MDCT coefficients associated with N windowed time-domain samples of the audio signal; an error detection section configured to identify the packet to be an erroneous packet in that the packet comprises one or more errors; an error concealment section configured to estimate a decoded frame comprising N/2 samples associated with the erroneous packet to be equal to a second half of a previous intermediate frame comprising non-windowed time-domain samples associated with a received packet, which directly precedes the erroneous packet in the sequence of packets.

In some example embodiments the method further comprises: determining available complexity resources and determining a method to apply for concealing errors based upon the available complexity resources.

IV. EXAMPLE EMBODIMENTS

Figure 1B:
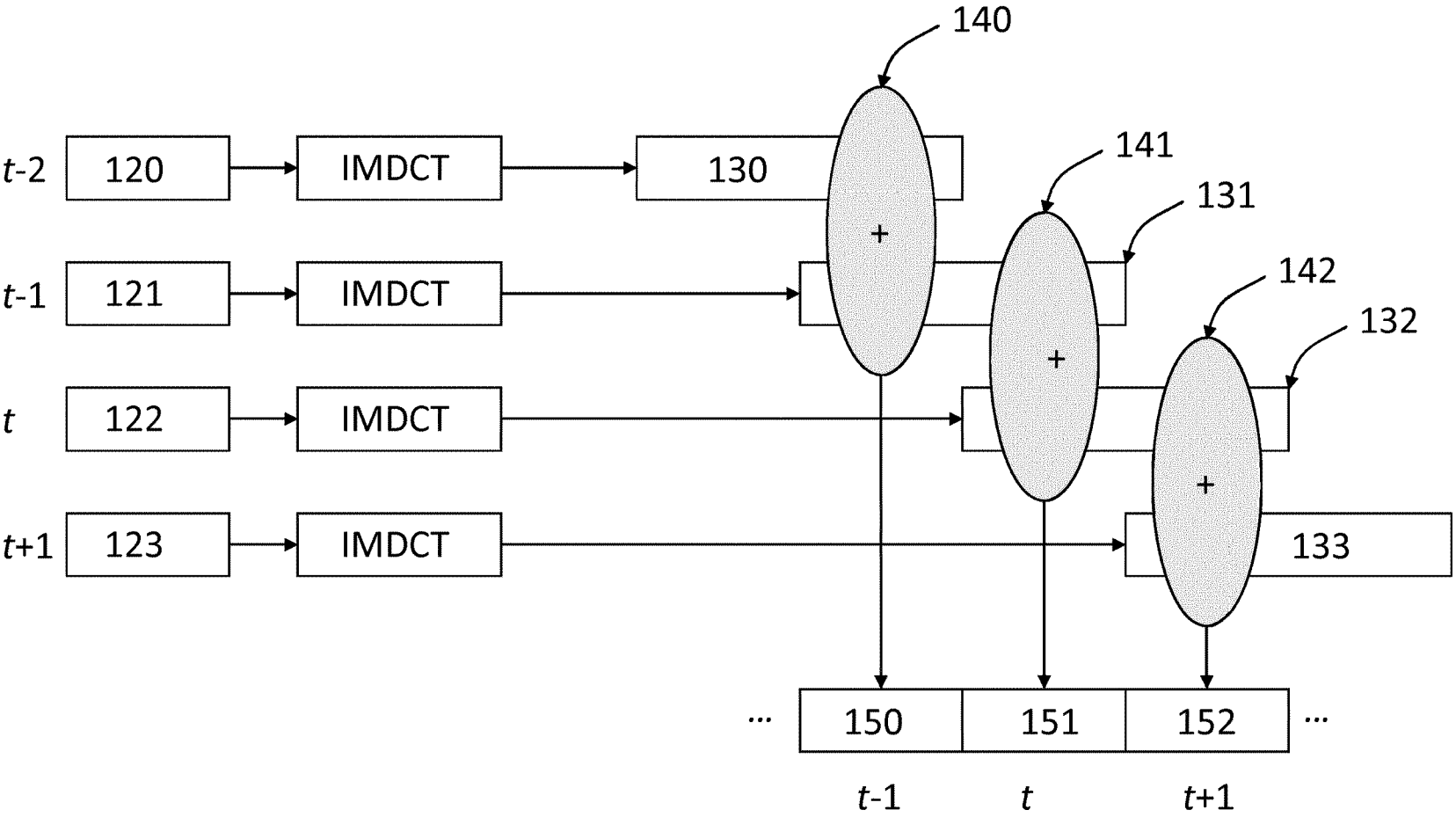

FIGS. 1A and 1B depict by way of example an MDCT and inverse transform, respectively together with which example embodiments may be implemented. In an audio encoding/decoding system an audio signal is typically sampled and divided into a sequence of frames 101-105 at an encoder side, wherein each frame of the sequence corresponds to a respective interval of time t−2, t−1, t, t+1, t+2. Each of the frames 101-105 comprises of N/2 samples, where N may be 2048, 1920, 1536 etc. depending on the encoder type and time frequency resolution selected. Instead of applying the MDCT to the frames 101-105, the MDCT is applied to combinations of two neighbouring frames. Hence, MDCT makes use of overlapping and is an example of a so-called overlapped transform. From a sequence of frames 101-105, each comprising N/2 time-domain samples of an audio signal, frames are combined two and two in consecutive order with overlap, such that for example, a first frame 101 and second frame 102 of the sequence of frames 101-105 are combined to a first combined frame 110, the second frame 102 and a third frame 103 are combined to a second combined frame 111 etc., which means that the first combined frame 110 and the second combined frame 111 have an overlap in that they both include the second frame 102. In order to smoothen the transition between sequential frames, a window function w[n] (n=0, . . . , N−1) is applied to each combination of two frames of the sequence of frames to generate combined frames 110-113 of N windowed time-domain samples. As depicted in FIG. 1A, the first and second frames 101 and 102 corresponding to time intervals t−2 and t−1, respectively, are combined and a windowing function is applied to the combination to generate a first combined frame 110 comprising N windowed time-domain samples $x_n^{(t-2)}$ (n=0, . . . , N−1), the second and third frames 102 and 103 corresponding to time intervals t−1 and t are combined and a windowing function is applied to the combination to generate a second combined frame 111 comprising N windowed time-domain samples $x_n^{(t-1)}$ (n=0, . . . , N−1), the third and fourth frames 103 and 104 corresponding to time intervals t and t+1 are combined and a windowing function is applied to the combination to generate a third combined frame 112 comprising N windowed time-domain samples $x_n^{(t)}$ (n=0, . . . , N−1), and the fourth and fifth frames 104 and 105 corresponding to time intervals t+1 and t+2 are combined and a windowing function is applied to the combination to generate a fourth combined frame 113 comprising N windowed time-domain samples $x_n^{(t+1)}$ (n=0, . . . , N−1).

An MDCT is then applied to the combined frames 110-113 resulting in a sequence of packets 120-123, each comprising N/2 MDCT coefficients. As depicted in FIG. 1A, an MDCT is applied to the first combined frame 110 to generate a first packet 120 comprising N/2 MDCT coefficients $c_k^{(t-2)}$ (k=0, . . . , N/2−1), an MDCT is applied to the second combined frame 111 to generate a second packet 121 comprising N/2 MDCT coefficients $c_k^{(t-1)}$ (k=0, . . . , N/2−1), an MDCT is applied to the third combined frame 112 to generate a third packet 122 comprising N/2 MDCT coefficients $c_k^{(t)}$ (k=0, . . . , N/2−1), and an MDCT is applied to the fourth combined frame 113 to generate a fourth packet 123 comprising N/2 MDCT coefficients $c_k^{(t+1)}$ (k=0, . . . , N/2−1).

At the decoder side, an IMDCT is applied to the packets 120-123, each comprising N/2 MDCT coefficients, to generate intermediate frames 130-133 comprising N time-domain aliased samples. As depicted in FIG. 1B, an IMDCT is applied to the first packet 120 to generate a first intermediate frame 130 comprising N windowed time-domain aliased samples $\hat{x}_n^{(t-2)}$ (n=0, . . . , N−1), an IMDCT is applied to the second packet 121 to generate a second intermediate frame 131 comprising N windowed time-domain aliased samples $\hat{x}_n^{(t-1)}$ (n=0, . . . , N−1), an IMDCT is applied to the third packet 122 to generate a third intermediate frame 132 comprising N windowed time-domain aliased samples $\hat{x}_n^{(t)}$ (n=0, . . . , N−1), and an IMDCT is applied to the fourth packet 123 to generate a fourth intermediate frame 133 comprising N windowed time-domain aliased samples $\hat{x}_n^{(t+1)}$ (n=0, . . . , N−1).

In order to generate decoded frames 150-152 of decoded samples, overlap add operations 140-142 are performed on the intermediate frames 130-133 under consideration of the window function w[n]. As depicted in FIG. 1B, a first overlap add operation 140 is performed between the first half of the second intermediate frame 131 and the second half of the first intermediate frame 130 to generate a first decoded frame 150 comprising N/2 decoded samples corresponding to time interval t−1, a second overlap add operation 141 is performed between the first half of the third intermediate frame 132 and the second half of the second intermediate frame 131 to generate a second decoded frame 151 comprising N/2 decoded samples corresponding to time interval t, a third overlap add operation 142 is performed between the first half of the fourth intermediate frame 133 and the second half of the third intermediate frame 132 to generate a third decoded frame 152 comprising N/2 decoded samples corresponding to time interval t+1.

Errors may occur in a packet comprising MDCT coefficients or a packet or a part of a packet may be lost. Unless the errors are corrected or lost packets are reconstructed, such errors or loss may affect the decoded frame in such a way that the decoded audio signal is impaired such that information is lost or unwanted artefacts occur in the decoded audio signal. For example and with reference to FIG. 1B, if errors are detected in the third packet 122 at the decoder side, the third intermediate frame 132 will normally be affected by the erroneous third packet 122. In the present document, a packet including errors will be referred to as an erroneous packet and the intermediate frame, corresponding to a same time interval as the erroneous packet, will be referred to as the intermediate frame associated with the erroneous packet, or the intermediate frame comprising N time-domain aliased samples associated with the erroneous packet. Furthermore, the second decoded frame 151 will normally be affected by the erroneous packet as the third intermediate frame 132 is used in the overlap add operation 141 to produce the second decoded frame 151. In the present document, the decoded frame, corresponding to the same time interval as the erroneous packet, will be referred to as the decoded frame associated with the erroneous packet. Furthermore, the third decoded frame 152 will also normally be affected by the erroneous packet as the third intermediate frame 132 is used also in the overlap add operation 142 to produce the third decoded frame 152.

Due to the overlap properties of the combined frames, a relation can be derived according to equation 1 between the first N/2 samples of the combined frame associated with time interval t and the last N/2 samples of the combined frame associated with time interval t−1:

$$x_n^{(t)} = x_{\frac{N}{2}+n}^{(t-1)}, \text{ for } n = 0, 1, \ldots, \frac{N}{2} - 1 \tag{1}$$

Furthermore, a decoded frame is generated using overlap add between a first half of an intermediate frame and a second half of a previous intermediate frame. Hence, a decoded frame associated with the time interval t is generated according to:

$$x_n^{(t)} = \hat{x}_{\frac{N}{2}+n}^{(t-1)} + \hat{x}_n^{(t)}, \text{ for } n = 0, 1, \ldots, \frac{N}{2} - 1 \tag{2}$$

Special properties between windowed time-domain samples of the intermediate frames can be used in estimating intermediate frames affected by an erroneous packet. More specifically, it can be proven that each intermediate frame possesses odd and even symmetries between the windowed time-domain samples of in the first and second half. For the time interval t, the following relations can be proven:

$$\left.\begin{aligned} \hat{x}_n^{(t)} &= -\hat{x}_{\frac{N}{2}-1-n}^{(t)} \\ \hat{x}_{\frac{N}{2}+n}^{(t)} &= \hat{x}_{N-1-n}^{(t)} \end{aligned}\right\} \text{ for } n = 0, 1, \ldots, \frac{N}{4} - 1 \tag{3}$$

Furthermore, it can be proven that windowed time-domain aliased samples can be derived explicitly in terms of the original windowed samples of the audio signal according to the following (see V. Britanak et al., "Fast computational structures for an efficient implementation of the complete TDAC analysis/synthesis MDCT/MDST filter banks", *Signal Processing*, Volume 89, Issue 7 (July 2009), pages 1379-1394, the contents of which is incorporated herein by reference):

$$\left.\begin{aligned} \hat{x}_n^{(t)} &= x_n^{(t)} - x_{\frac{N}{2}-1-n}^{(t)} \\ \hat{x}_{\frac{N}{2}+n}^{(t)} &= x_{\frac{N}{2}+n}^{(t)} + x_{N-1-n}^{(t)} \end{aligned}\right\} \text{ for } n = 0, 1, \ldots, \frac{N}{4} - 1 \tag{4}$$

Using equation (1) in equation (4), the following relation is derived:

$$\left.\begin{aligned} \hat{x}_n^{(t)} &= x_{\frac{N}{2}+n}^{(t-1)} - x_{N-1-n}^{(t-1)} \\ \hat{x}_{\frac{N}{2}+n}^{(t)} &= x_n^{(t+1)} + x_{\frac{N}{2}-1-n}^{(t+1)} \end{aligned}\right\} \text{ for } n = 0, 1, \ldots, \frac{N}{4} - 1 \tag{5}$$

In another approximation decoded frames affected by an erroneous packet can be estimated using frames of a non-windowed time-domain aliased signal $\tilde{x}_n$ according to the following:

$$\left.\begin{aligned} \tilde{x}_{\frac{N}{2}+n}^{(t-1)} &\rightarrow x_n^{(t)} \\ \tilde{x}_{N-1-n}^{(t-1)} &\rightarrow x_{\frac{N}{2}-1-n}^{(t)} \end{aligned}\right\} \text{ for } n = 0, 1, \ldots, \frac{N}{4} - 1 \tag{6}$$

$$\left.\begin{aligned} \tilde{x}_n^{(t+1)} &\rightarrow x_n^{(t+1)} \\ \tilde{x}_{\frac{N}{2}-1-n}^{(t+1)} &\rightarrow x_{\frac{N}{2}-1-n}^{(t+1)} \end{aligned}\right\} \text{ for } n = 0, 1, \ldots, \frac{N}{4} - 1 \tag{7}$$

In equations (6) and (7), the notation a→b indicates that variable b is assigned value a.

Figure 2:
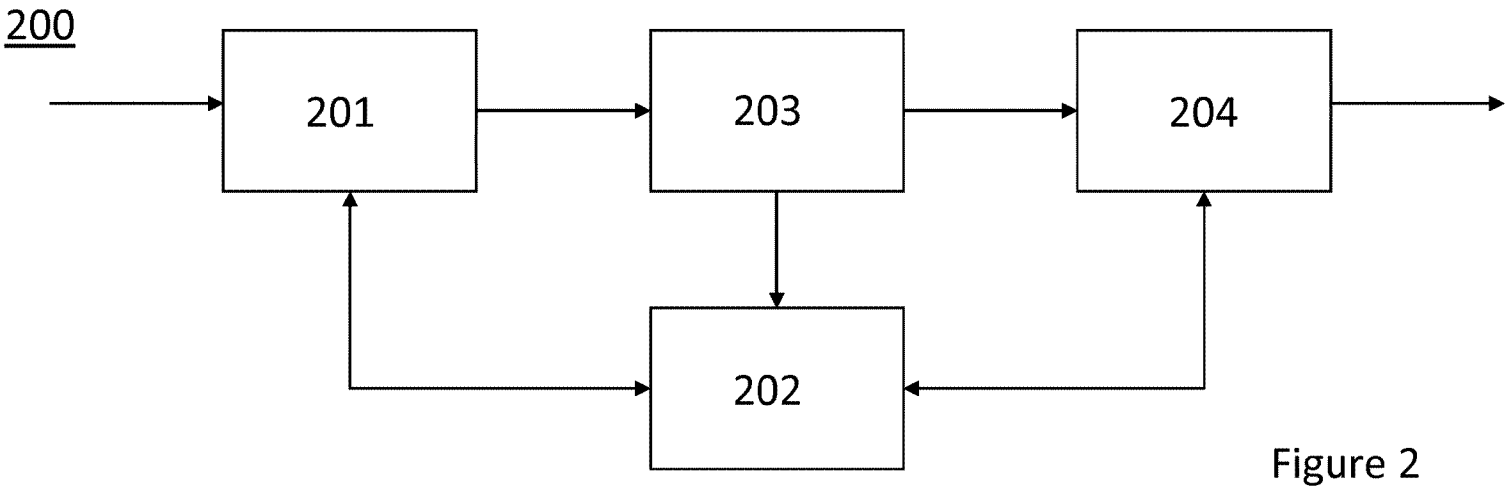
FIG. 2 is a generalized block diagram of a first decoding system.

FIG. 2 depicts by way of example a generalized block diagram of a first decoding system 200. The decoding system 200 is arranged to conceal errors in packets of data that are to be decoded in a MDCT based audio decoder arranged to decode a sequence of packets into a sequence of decoded frames.

The system includes a receiver section 201 configured to receive a sequence of packets where each packet comprises a set of MDCT coefficients associated with a frame comprising time-domain samples of the audio signal. The sequence of packets is typically generated as described in relation to FIG. 1A by applying an MDCT to combined frames of N windowed time-domain samples. Each packet of the sequence of packets includes N/2 MDCT coefficients.

The decoding system 200 further comprises an error detection section (not shown) configured to identify if a received packet is an erroneous packet in that the received packet comprises one or more errors. The way errors are detected in the error detection section is arbitrary and the location of the error detection section is also arbitrary as long as erroneous packets that require error concealment are detected and the detected erroneous packets can be identified in the error concealment of the decoding system 200.

The decoding system 200 further comprises an error concealment section 202 configured to estimate MDCT coefficients of erroneous packets, assign signs to the estimated MDCT coefficients, generate concealment packets and replace the erroneous packets with the concealment packets in the sequence of packets. The concealment packet is generated as the estimated MDCT coefficients with the corresponding selected signs of the erroneous packet.

The decoding system 200 further comprises an IMDCT section 203 for applying an IMDCT to each of the packets of the sequence of packets including concealment packets which replace erroneous packets in the sequence of packets. The output from the IMDCT section 203 is a sequence of intermediate frames of N windowed time-domain aliased samples.

The decoding system 200 further comprises an overlap add section 204 for performing overlap add operation between overlapping portions of consecutive intermediate frames in the sequence of intermediate frames in order to generate decoded frames of N/2 samples.

In one embodiment, the estimated MDCT coefficients are based on corresponding MDCT coefficients associated with a received packet, which directly precedes the erroneous packet in the sequence of packets. In a further embodiment, the estimated MDCT coefficients are selected to be equal to the corresponding MDCT coefficients of the received packet, which directly precedes the erroneous packet in the sequence of packets. Furthermore, signs of a first subset of MDCT coefficients of the estimated MDCT coefficients are assigned to be equal to corresponding signs of the corresponding MDCT coefficients of the received packet, which directly precedes the erroneous packet in the sequence of packets. The first subset comprises such MDCT coefficients that are associated with tonal-like spectral bins of the packet. Signs of a second subset of MDCT coefficients of the estimated MDCT coefficients are randomly assigned. The second subset comprises such MDCT coefficients that are associated with noise-like spectral bins of the packet. The error concealment section 202 continuously receives MDCT coefficients of each packet of the sequence of packets from the receiving section 201 together with the signs for each of the MDCT coefficients. The error concealment section 202 further receives identification of erroneous frames from the receiving section. When an erroneous frame is received, the error concealment section 202 can extract the MDCT coefficients and corresponding signs of a previous packet received directly before the erroneous packet in the sequence of packets and generate estimated MDCT coefficients of the erroneous packet and assign signs using the MDCT coefficients and signs together from the previous packet. When coefficients and signs have been estimated and assigned, a concealment packet based on the estimated MDCT coefficients and the selected signs of the packet is generated and the error concealment section replaces the erroneous packet with the concealment packet in the receiving section 201 and the concealment packet is forwarded from the receiving section 201 to the MDCT section 203.

It is to be noted that when referring to estimated MDCT coefficients in relation to estimation together with assigning a sign to each of the estimated MDCT coefficients, this implicitly refers to the absolute value of the estimated MDCT coefficients. Even though assignment of sign for the MDCT coefficients is disclosed for the first subset first and the second subset second, assignment of sign may be performed in opposite order. Hence, in example embodiment the assignment may be performed for the second subset first and first subset last. In fact, assignment may be performed for the MDCT coefficients in any order. In example embodiment the assignment may not necessarily be performed consecutively for all MDCT coefficients associated with tonal-like spectral bins and consecutively for all MDCT coefficients associated with noise-like spectral bins. For example, assignment may first be made for one or more of the MDCT coefficients associated with the first subset, then for one or more of the MDCT coefficients associated with the second subset, then for one or more of the MDCT coefficients associated with the first subset etc. Furthermore, a packet does not necessarily have MDCT coefficients associated with both noise-like spectral bins and tonal-like spectral bins. Instead, a packet may have all MDCT coefficients associated with noise-like spectral bins or all associated with tonal-like spectral bins such that one of the first subset and the second subset is empty. Finally, an MDCT coefficient is typically identified as either belonging to the first subset or belonging to the second subset.

Estimating signs of MDCT coefficients based on content type may provide an improved result in terms of error concealment properties than estimation using only random assignment or estimations based only on signs of MDCT coefficients of previously received packets in the sequence of packets. MDCT coefficients relating to noise-like spectral bins may be sufficiently accurate if estimated by means of random assignment, whereas MDCT coefficients relating to tonal-like spectral bins may provide improved results in terms of error concealment properties by means of assignment based on corresponding MDCT coefficients of the received packet, which directly precedes the erroneous packet in the sequence of packets. Furthermore, as the MDCT coefficients are estimated based on corresponding MDCT coefficients associated with the received packet, which directly precedes the erroneous packet in the sequence of packets, error concealment can be achieved using data from previously received packets only.

In some prior art, more complex methods have been used including estimation of signs for all MDCT coefficients and using no random assignment. In other prior art, additional metadata have been provided for use in estimating the sign which adds further complexity to the method and requires change of the data streams from the coder to the decoder. Furthermore, such metadata has to be transferred in packets following the erroneous packets which delays the time when estimation of signs can be performed in the decoding system.

By selecting the estimated MDCT coefficients to be equal to the corresponding MDCT coefficients of a preceding packet, complexity may be kept low whilst a concealment packet may be achieved providing desired error concealment properties if this is combined with estimation of signs of MDCT coefficients based on content type according to example embodiments.

In a further embodiment the MDCT coefficients of the previous packet are energy adjusted in scale-factor band resolution by an energy scaling factor before they are selected as an estimation of the MDCT coefficients of the erroneous packet.

By selecting the estimated MDCT coefficients to be equal to the corresponding MDCT coefficients of a preceding packet, energy adjusted in scale-factor band resolution by an energy scaling factor, the error concealment properties achieved by the concealment packet may be enhanced whilst complexity may only be increased slightly.

There are several alternative ways of determining whether a MDCT coefficient of a packet (for example an erroneous packet) in the sequence of packets is associated with a tonal-like spectral bin or a noise-like spectral bin. In one example, the determining is based on spectral peak detection of an approximation of a power spectrum associated with the erroneous packet, wherein the approximated power spectrum is based on the power spectrum associated with the received packet, which directly precedes the erroneous packet in the sequence of packets. In another example, a MDCT sub-band spectral flatness measure is used. If the value of a MDCT sub-band spectral flatness is above a certain threshold the sub-band spectrum is flat which implies that it is noisy. Otherwise, the spectrum is peaky which implies that it is tonal. MDCT sub-band flatness is estimated as the ratio between the geometric mean and the arithmetic mean of the magnitude of MDCT coefficients. It expresses the deviation of a power spectrum of a signal from a flat shape. This measure is computed on a band-by-band basis, where the term "band" relates to a set of MDCT coefficients and the width of these bands are according to perceptually relevant scale-factor band resolution. For a description of spectral flatness measure reference is made to N. Jayant and P. Noll, *Digital Coding of Waveforms, Principles and Applications to Speech and Video*, Englewood Cliffs, N.J.: Prentice-Hall (1984). In a further example, determining is based on metadata received in the packets or in a bit stream comprising the sequence of packets and the metadata. The metadata to be used may for example be metadata used for controlling certain audio decoder processing based on audio content-type. In AC-4 for example, there is a companding tool which has to be switched off for tonal signals. Hence, if metadata is received indicating that the companding is switched off, the signal can be assumed to be tonal. Also, if for example longest MDCT is used, the audio content is most likely a tonal signal.

In one embodiment, the symmetry relations of equation (3) between the windowed time-domain aliased samples of the intermediate frame associated with an erroneous frame are used to modify the windowed time-domain aliased samples of the intermediate frame associated with an erroneous frame. When an erroneous frame has been identified associated with time interval t, a concealment packet is generated in the error concealment section 202 and the concealment packet replaces the erroneous frame. In the IMDCT section 203, an IMDCT is applied to the concealment packet which generates an intermediate frame associated with the erroneous packet. The generated intermediate frame associated with the erroneous packet is forwarded from the IMDCT section 203 to the error concealment section 202. The error concealment section 202 then modifies the windowed time-domain aliased samples of the generated intermediate frame such that the relations of equation (3) are better satisfied.

Symmetry relations that can be proved between windowed time-domain aliased samples of the intermediate frame may be used to modify windowed time-domain aliased samples of the intermediate frame in order to enhance error concealment properties. An enhancement of the error concealment properties may then achieved whilst complexity may only be increased slightly.

In a further embodiment, the relations of equation (5) between the windowed time-domain aliased samples of the intermediate frame associated with an erroneous frame and the original data samples are used to modify the windowed time-domain aliased samples of the intermediate frame associated with an erroneous frame. When an erroneous frame has been identified associated with time interval t, a concealment packet is generated in the error concealment section 202 and the concealment packet replaces the erroneous frame. In the IMDCT section 203, an IMDCT is applied to the concealment packet which generates an intermediate frame associated with the erroneous packet. The generated intermediate frame associated with the erroneous packet is forwarded from the IMDCT section 203 to the error concealment section 202. The error concealment section 202 then modifies the windowed time-domain aliased samples of the generated intermediate frame such that the relations of equation (5) are better satisfied. For example, the right hand side of the first relation of equation (5) relating to the first half of the intermediate frame associated with the erroneous packet is approximated by a past decoded frame associated with time interval t−1 received in the error estimation section 202 from the overlap add section 204. The result is an alternative estimation of the first half of the intermediate frame associated with the erroneous packet which can be used to modify the first half of the intermediate frame associated with the erroneous packet as generated by applying an IMDCT to the concealment packet generated in the concealment section 202. Furthermore, the right hand side of the second relation of equation (5) relating to the second half of the intermediate frame associated with the erroneous packet is approximated by a decoded frame associated with time interval t, that is the decoded frame based on the modified first half of the intermediate frame associated with the erroneous packet. The decoded frame associated with time interval t is received in the error estimation section 202 from the overlap add section 204. The result is an alternative estimation of the second half of the intermediate frame associated with the erroneous packet which can be used to modify the second half of the intermediate frame associated with the erroneous packet as generated by applying an IMDCT to the concealment packet generated in the concealment section 202.

Figure 3:
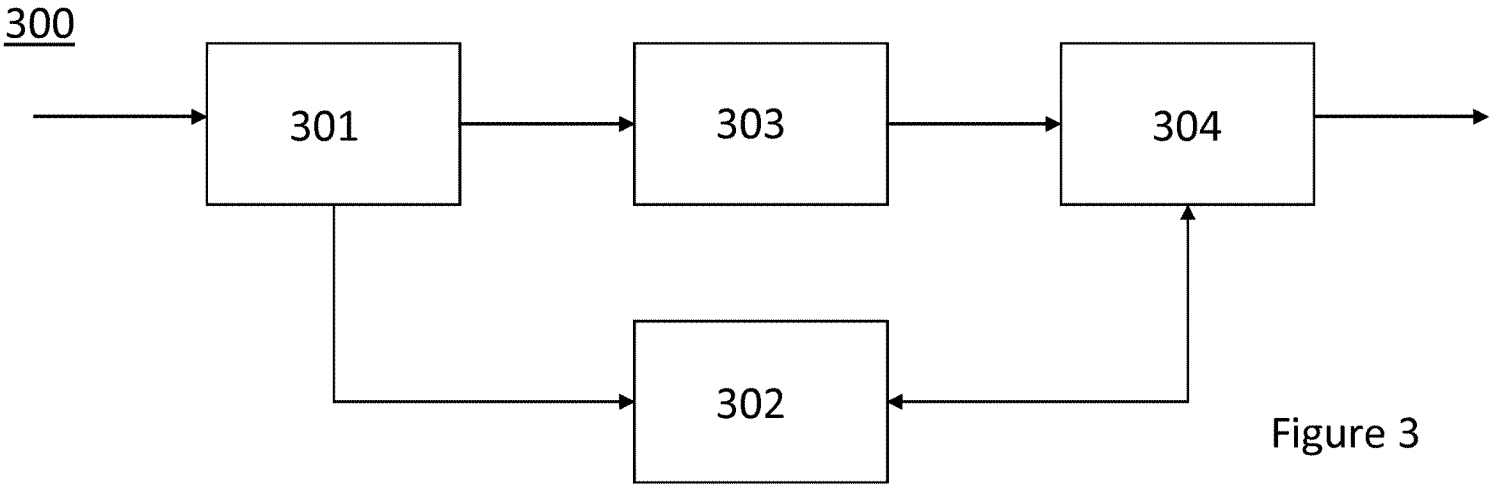
FIG. 3 is a generalized block diagram of a second decoding system.

FIG. 3 depicts by way of example a generalized block diagram of a second decoding system 300. The decoding system 300 is arranged to conceal errors in packets of data that are to be decoded in a MDCT based audio decoder arranged to decode a sequence of packets into a sequence of decoded frames.

The system includes a receiver section 301 configured to receive a sequence of packets where each packet comprises a set of MDCT coefficients associated with a frame comprising time-domain samples of the audio signal. The sequence of packets is typically generated as described in relation to FIG. 1A by applying an MDCT to combined frames of N windowed time-domain samples. Each packet of the sequence of packets includes N/2 MDCT coefficients.

The decoding system 300 further comprises an error detection section (not shown) configured to identify if a received packet is an erroneous packet in that the received packet comprises one or more errors. The way errors are detected in the error detection section is arbitrary and the location of the error detection section is also arbitrary as long as erroneous packets are detected that require error concealment and that the detected erroneous packets can be identified in the error concealment of the decoding system 300.

The decoding system 300 further comprises an error concealment section 302 configured to estimate the windowed time-domain aliased samples of an intermediate frame comprising N windowed time-domain aliased samples associated with the erroneous packet.

The decoding system 300 further comprises an IMDCT section 303 for applying an IMDCT to each of the packets of the sequence of packets. The output from the IMDCT section 303 is a sequence of intermediate frames of N windowed time-domain aliased samples.

The error concealment section 302 is further configured to replace an intermediate frame comprising N windowed time-domain aliased samples associated with an erroneous packet with an estimated intermediate frame.

The decoding system 300 further comprises an overlap add section 304 for performing overlap add operation between overlapping portions of consecutive intermediate frames in the sequence of intermediate frames in order to generate decoded frames of N/2 samples.

In an embodiment, when an erroneous packet is identified in a time interval t, an intermediate frame associated with the erroneous packet may be estimated. The estimation is performed using the relation between windowed time-domain aliased samples of the intermediate frame associated with time interval t and terms of the original windowed samples of the audio signal of equation (5) and the symmetry relations of equation (3). A first subset comprising the first N/4 windowed time-domain aliased samples of the first half of the intermediate frame comprising N windowed time-domain aliased samples associated with the erroneous packet, that is associated with timer interval t, are estimated. The estimation is made by means of the first relation of equation (5), where the samples of right hand side are approximated with samples of the previous decoded frame, where the previous decoded frame is associated with time interval t−1. The decoded frame associated with time interval t−1 is received in the error estimation section 302 from the overlap add section 304. More specifically, sample number n of the first subset is estimated as a windowed version of sample number n of the previous decoded frame minus a windowed version of sample number N/2−1−n of the previous decoded frame for n=0, 1 . . . , N/4−1. The second subset comprising the remaining, that is the last, N/4 windowed time-domain aliased samples of the first half of the intermediate frame are estimated by means of the symmetry relations of equation (3). An estimated decoded frame associated with the erroneous packet, that is associated with time interval t, is generated in the overlap add section 304 by adding the first half of the estimated intermediate frame to a second half of a previous intermediate frame associated with the received packet, which directly precedes the erroneous packet in the sequence of packets, that is associated with time interval t−1.

By using symmetry relations between windowed time-domain aliased samples of the second subset and windowed time-domain aliased samples of the first subset to estimate the second subset, a reduction of the complexity of the estimation may be achieved whilst maintaining the achieved error concealment properties.

By using the previous decoded frame as an approximation in the relations between windowed time-domain aliased samples of the first subset and windowed time-domain samples of the N windowed time-domain samples of the audio signal for generating the estimation of the first subset, a low complexity of the estimation may be achieved whilst achieving desired error concealment properties.

A third subset comprising the first N/4 windowed time-domain aliased samples of a second half of the intermediate frame associated with the erroneous packet is estimated. The estimation is made by means of the second relation of equation (5), where the samples of right hand side are approximated with samples of the estimated decoded frame, where the estimated decoded frame is associated with the erroneous packet, that is with time interval t. The estimated decoded frame associated with time interval t is received in the error estimation section 302 from the overlap add section 304. More specifically, sample number n of the third subset is estimated as a windowed version of sample number n of the estimated decoded frame plus a windowed version of sample number N/2−1−n of the estimated decoded frame for n=0, 1, . . . , N/4−1. The fourth subset comprising remaining, that is the last, N/4 windowed time-domain aliased samples of the second half of the intermediate frame are estimated by means of the symmetry relations of equation (3). It is to be noted that sample number n of the third subset is sample number N/2+n of the intermediate frame for n=0, 1, . . . , N/4−1 as the third subset is the first half of the second half of the intermediate frame. A subsequent estimated decoded frame associated with the received packet, which directly follows the erroneous packet, that is associated with time interval t+1, is generated in the overlap add section 304 by adding the second half of the estimated intermediate frame associated with time interval t to a first half of the subsequent estimated intermediate frame.

In an alternative embodiment, the estimation of the first subset is based on an offset set comprising N/2 samples of a previous decoded frame associated with time interval t−1, and a further previous decoded frame associated time interval t−2 (not shown) and the estimation of the third subset is based on an offset set comprising N/2 samples of an estimated decoded frame associated with time interval t, and the previous decoded frame associated time interval t−1. The offset set comprising k last samples of the further previous decoded frame and all samples except the k last samples of the previous decoded frame, where k<N/2. More specifically, for k≤×N/4−1, sample number n of the first subset is estimated as a windowed version of sample number N/2−1+n−k of the further previous decoded frame (not shown) minus a windowed version of sample number N/2−1−n−k of the previous decoded frame for n=0, 1, . . . , k. Sample number n of the first subset is estimated as windowed version of sample number n−k−1 of the previous decoded frame minus a windowed version of sample number N/2−1−n−k of the previous decoded frame for n equals k+1, . . . , N/4−1. Sample number n of the third subset is estimated as a windowed version of sample N/2−1+n−k of the previous decoded frame minus a windowed version of sample number N/2−1−n−k of the estimated decoded frame for n=0, 1, . . . , k. Sample number n of the third subset is estimated as a windowed version of sample number n−k−1 of the estimated decoded frame plus a windowed version of sample number N/2−1−n−k of the estimated decoded frame for n=k+1, . . . , N/4−1.

The value of k may be computed to maximize self-similarity of a frame to be estimated with previous frames or it may be pre-computed to save complexity. Furthermore, k is typically dependent on N.

Error concealment properties may be improved in relation to when windowed versions of the samples of the previous decoded frame only are used for estimating the windowed time-domain aliased samples of the first subset. More specifically, enhanced error concealment properties may result from using an offset by a number of samples or an offset in time in the estimation of the windowed time-domain aliased samples of the first subset.

Figure 4:
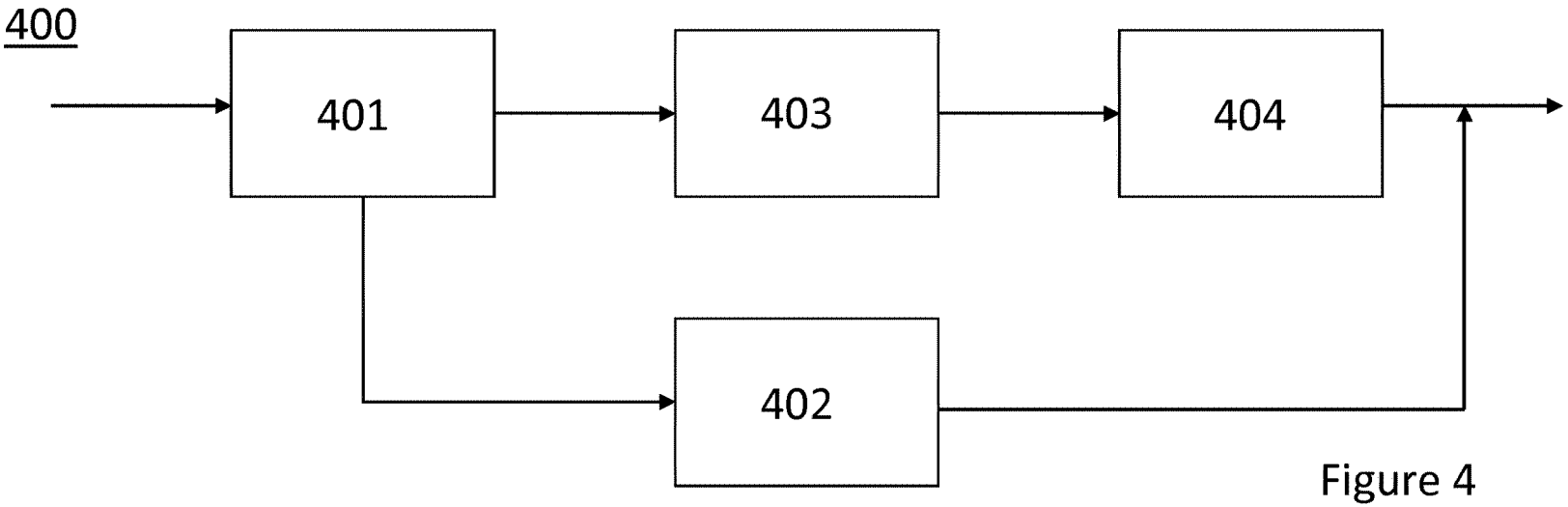
FIG. 4 is a generalized block diagram of a third decoding system.

FIG. 4 depicts by way of example a generalized block diagram of a third decoding system 400. The decoding system 400 is arranged to conceal errors in packets of data that are to be decoded in a MDCT based audio decoder arranged to decode a sequence of packets into a sequence of decoded frames.

The system includes a receiver section 401 configured to receive a sequence of packets where each packet comprises a set of MDCT coefficients associated with a frame comprising time-domain samples of the audio signal. The sequence of packets is typically generated as described in relation to FIG. 1A by applying an MDCT to combined frames of N windowed time-domain samples. Each packet of the sequence of packets includes N/2 MDCT coefficients.

The decoding system 400 further comprises an error detection section (not shown) configured to identify if a received packet is an erroneous packet in that the received packet comprises one or more errors. The way errors are detected in the error detection section is arbitrary and the location of the error detection section is also arbitrary as long as erroneous packets are detected that require error concealment and that the detected erroneous packets can be identified in the error concealment of the decoding system 400.

The decoding system 400 further comprises an error concealment section 402 configured to estimated a decoded frame comprising N/2 samples associated with the erroneous packet to generate an estimated decoded frame. The decoded frame is estimated to be equal to a second half of a previous intermediate frame comprising N non-windowed time-domain samples associated with a received packet, which directly precedes the erroneous packet in the sequence of packets.

The decoding system 400 further comprises an IMDCT section 403 for applying an IMDCT to each of the packets of the sequence of packets. The output from the IMDCT section 403 is a sequence of intermediate frames of N windowed time-domain aliased samples.

The decoding system 400 further comprises an overlap add section 404 for performing overlap add operation between overlapping portions of consecutive intermediate frames in the sequence of intermediate frames in order to generate decoded frames of N/2 samples.

The error concealment section 402 is further configured to estimate a subsequent decoded frame comprising N/2 samples associated with a received packet, which directly follows the erroneous packet in the sequence of packet, to be equal to a first half of an subsequent intermediate frame comprising non-windowed time-domain samples associated with the received packet, which directly follows the erroneous packet in the sequence of packets. The error concealment section 402 is further configured to replace a decoded frame associated with the erroneous packet from the overlap add section 404 with the estimated decoded packet and to replace a subsequent decoded frame associated with the erroneous packet from the overlap add section 404 with the estimated decoded packet.

The decoding system 400 makes use of the approximations of equations (6) and (7).

Estimation of samples of a decoded frame of samples associated with the erroneous packet with non-windowed time-domain samples of a previous intermediate frame may provide a low complexity method for providing error concealment.

Furthermore, an adaptable method may be provided where available complexity resources are determined, for example the method continuously determine the level of complexity allowed for error concealment. For example, when an erroneous packet is identified, the available complexity resources are determined and, a method for error concealment is selected in accordance with the determined available resources.

V. EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The devices and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). The software may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms. As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. As used in this application, the term "section" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

The invention claimed is:

1. A method for concealing errors in packets of data that are to be decoded in a modified discrete cosine transform (MDCT) based audio decoder arranged to decode a sequence of packets into a sequence of decoded frames, the method comprising:

receiving, from an MDCT based audio encoder arranged to encode an audio signal, a packet comprising a set of MDCT coefficients associated with a frame comprising time-domain samples of the audio signal;

identifying the received packet to be an erroneous packet in that the received packet comprises one or more errors;

generating estimated MDCT coefficients to replace the set of MDCT coefficients of the erroneous packet, the estimated MDCT coefficients being based on corresponding MDCT coefficients associated with a received packet, which directly precedes the erroneous packet in the sequence of packets;

determining, for each of the estimated MDCT coefficients, whether the MDCT coefficient is associated with a tonal-like spectral bin or a noise-like spectral bin based on metadata associated with the packet, wherein the metadata is received in a bit stream comprising the sequence of packets and the metadata, and wherein said metadata comprises companding metadata or MDCT length metadata;

assigning signs of a first subset of MDCT coefficients of the estimated MDCT coefficients, wherein the first subset comprises such MDCT coefficients that are associated with tonal-like spectral bins of the packet, to be equal to corresponding signs of the corresponding MDCT coefficients of the received packet, which directly precedes the erroneous packet in said sequence of packets;

randomly assigning signs of a second subset of MDCT coefficients of the estimated MDCT coefficients, wherein the second subset comprises such MDCT coefficients that are associated with noise-like spectral bins of the packet;

generating a concealment packet based on the estimated MDCT coefficients and the selected signs of the packet; and replacing the erroneous packet with the concealment packet.

2. The method of claim 1, wherein the estimated MDCT coefficients are selected to be equal to the corresponding MDCT coefficients of the received packet, which directly precedes the erroneous packet in said sequence of packets.

3. The method of claim 1, wherein the estimated MDCT coefficients are selected to be equal to the corresponding MDCT coefficients of the received packet, which directly precedes the erroneous packet in said sequence of packets, energy adjusted in scale-factor band resolution by an energy scaling factor.

4. The method of claim 1, wherein the received packet comprises N/2 MDCT coefficients associated with N windowed time-domain samples of the audio signal, further comprising:

generating an intermediate frame comprising N windowed time-domain aliased samples from the concealment frame by means of inverse MDCT (IMDCT);

modifying windowed time-domain aliased samples of the intermediate frame based on symmetry relations between the windowed time-domain aliased samples of the intermediate frame.

5. The method of claim 4, wherein the modifying uses symmetry relations between the first half of the first half of the intermediate frame comprising N windowed time-domain aliased samples and the second half of the first half of the intermediate frame comprising N windowed time-domain aliased samples, and symmetry relations between the first half of the second half of the intermediate frame comprising N windowed time-domain aliased samples and the second half of the second half of the intermediate frame comprising N windowed time-domain aliased samples.

6. The method of claim 1, wherein the received packet comprises N/2 MDCT coefficients associated with N windowed time-domain samples of the audio signal, further comprising:

generating an intermediate frame comprising N windowed time-domain aliased samples from the concealment frame by means of IMDCT;

modifying windowed time-domain aliased samples of the intermediate frame based on relations between the windowed time-domain aliased samples of the intermediate frame and windowed time-domain samples of the N time-domain samples of the audio signal.

7. The method of claim 1, wherein the received packet comprises N/2 MDCT coefficients associated with N windowed time-domain samples of the audio signal, further comprising:

generating an estimated decoded frame by adding first half of the generated intermediate frame to a second half of a previous generated intermediate frame comprising N windowed time-domain aliased samples associated with the received packet, which directly precedes the erroneous packet in the sequence of packets.

8. The method of claim 1, wherein the received packet comprises N/2 MDCT coefficients associated with N windowed time-domain samples of the audio signal, further comprising:

generating an intermediate frame comprising N windowed time-domain aliased samples from the concealment frame by means of IMDCT;

generating an estimated decoded frame by adding first half of the generated intermediate frame to a second half of a previous generated intermediate frame comprising N windowed time-domain aliased samples associated with the received packet, which directly precedes the erroneous packet in the sequence of packets.

9. A decoding system for concealing errors in packets of data that are to be decoded in a modified discrete cosine transform (MDCT) based audio decoder arranged to decode a sequence of packets into a sequence of decoded frames, the system comprising:

a receiver section configured to receive, from an MDCT based audio encoder arranged to encode an audio signal, a packet comprising a set of MDCT coefficients associated with a frame comprising time-domain samples of the audio signal;

an error detection section configured to identify the received packet to be an erroneous packet in that the received packet comprises one or more errors; and an error concealment section configured to:

generate estimated MDCT coefficients to replace the set of MDCT coefficients of the erroneous packet, the estimated MDCT coefficients being based on corresponding MDCT coefficients associated with a received packet, which directly precedes the erroneous packet in the sequence of packets; assign signs of a first subset of MDCT coefficients of the estimated MDCT coefficients, wherein the first subset comprises such MDCT coefficients that are associated with tonal-like spectral bins of the packet, to be equal to corresponding signs of the corresponding MDCT coefficients of the received packet, which directly precedes the erroneous packet in the sequence of packets;

randomly assign signs of a second subset of MDCT coefficients of the estimated MDCT coefficients, wherein the second subset comprises such MDCT coefficients that are associated with noise-like spectral bins of the packet;

generate a concealment packet based on the estimated MDCT coefficients and the selected signs of the packet; and replace the erroneous packet with the concealment packet, wherein the decoding system is configured to determine, for each of the estimated MDCT coefficients, whether the MDCT coefficient is associated with a tonal-like spectral bin or a noise-like spectral bin based on metadata associated with the packet, wherein the receiver section is configured to receive the metadata in a bit stream comprising the sequence of packets and the metadata, and wherein said metadata comprises companding metadata or MDCT length metadata.

10. A computer program product comprising a non-transitory computer-readable medium with instructions for performing the method of claim 1.

* * * * *